US005227804A

United States Patent [19]

Oda

[11] Patent Number: 5,227,804

[45] Date of Patent: Jul. 13, 1993

[54] ANTENNA STRUCTURE USED IN PORTABLE RADIO DEVICE

[75] Inventor: Takashi Oda, Tokyo, Japan

[73] Assignee: NEC Corporation, Tokyo, Japan

[21] Appl. No.: 742,076

[22] Filed: Aug. 7, 1991

Related U.S. Application Data

[63] Continuation of Ser. No. 375,558, Jul. 5, 1989, abandoned.

[30] Foreign Application Priority Data

Jul. 5, 1988 [JP] Japan ..... 63-168175

[51] Int. Cl.[5] ..... H01Q 1/24

[52] U.S. Cl. ..... 343/702; 343/720; 343/856

[58] Field of Search ..... 343/702, 743, 744, 867, 343/866, 720, 856, 729, 741

[56] References Cited

U.S. PATENT DOCUMENTS

| | | | |
|---|---|---|---|
| 3,736,591 | 5/1973 | Rennels et al. | 343/702 |
| 4,590,614 | 5/1986 | Erat | 343/702 |
| 4,591,863 | 5/1986 | Patsiokas | 343/702 |
| 4,814,776 | 3/1989 | Gaci et al. | 343/748 |
| 4,862,181 | 8/1989 | Ponce de Leon et al. | 343/702 |
| 4,864,636 | 9/1989 | Brunius | 343/702 |
| 4,873,527 | 10/1989 | Tan | 343/718 |

FOREIGN PATENT DOCUMENTS

| | | | |
|---|---|---|---|
| 676743 | 12/1963 | Canada | 343/788 |

*Primary Examiner*—Michael C. Wimer
*Assistant Examiner*—Hoanganh Le
*Attorney, Agent, or Firm*—Sughrue, Mion, Zinn, Macpeak & Seas

[57] ABSTRACT

An antenna structure comprises a loop antenna electrically connected to a high-frequency circuit of a portable radio device. The antenna structure also comprises a supplemental antenna including a coil spring which is used for fixing a dry battery powering the portable radio device, and a negative cylindrical conductor of the dry battery which conductor is electrically connected with the coil spring. The coil spring is placed to be inductively coupled to the loop antenna. The longitudinal axis of the dry battery is substantially perpendicular to a plane including the loop antenna. Thus, deterioration in signal reception sensitivity due to the directivity of the loop antenna can be compensated by the supplemental antenna.

26 Claims, 3 Drawing Sheets

FIG. 1 PRIOR ART
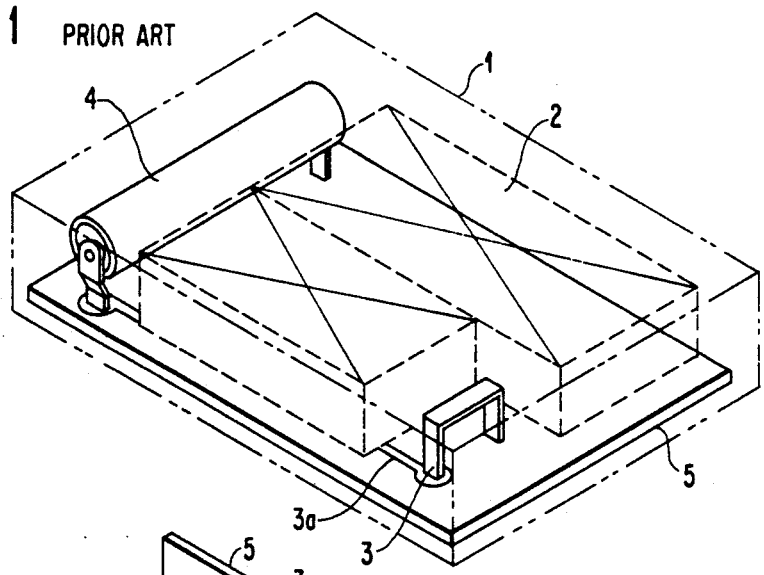
FIG. 2a PRIOR ART
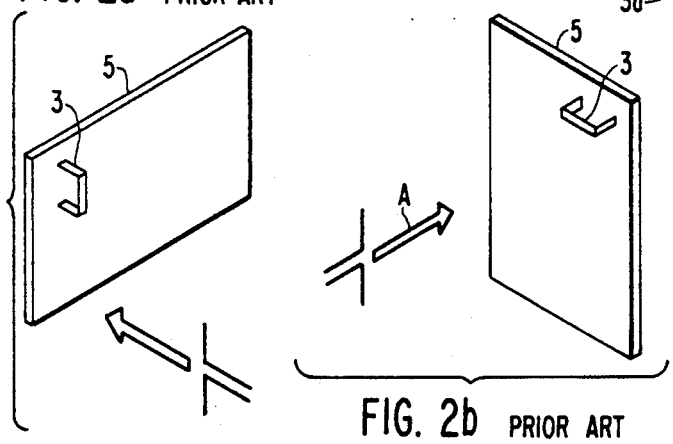
FIG. 2b PRIOR ART
FIG. 3
PRIOR ART
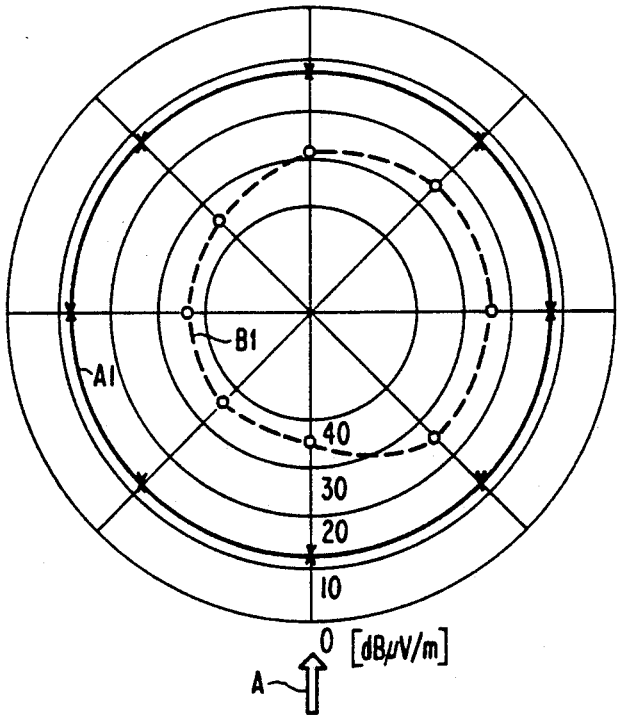

FIG. 7
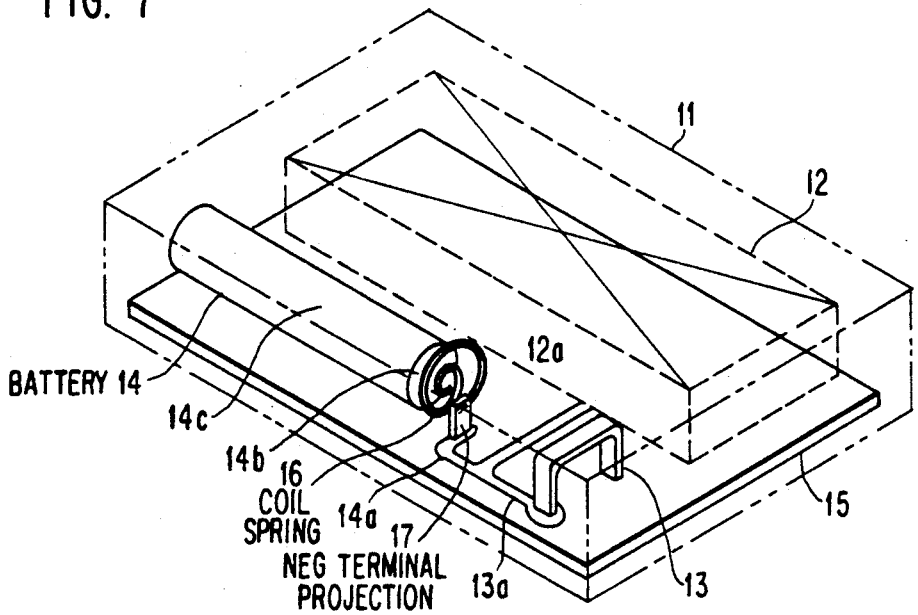
FIG. 8a
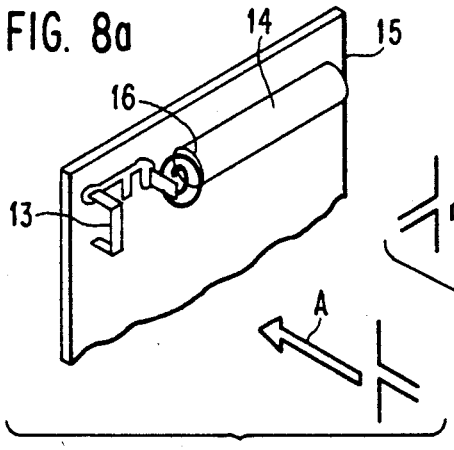
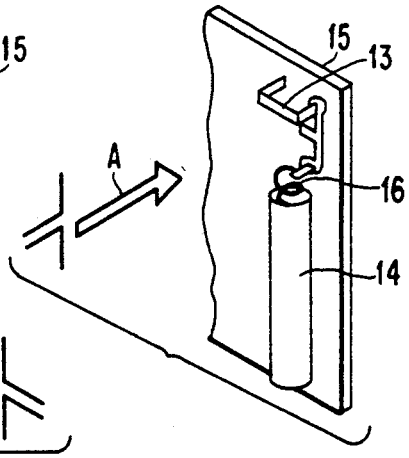
FIG. 8b
FIG. 9
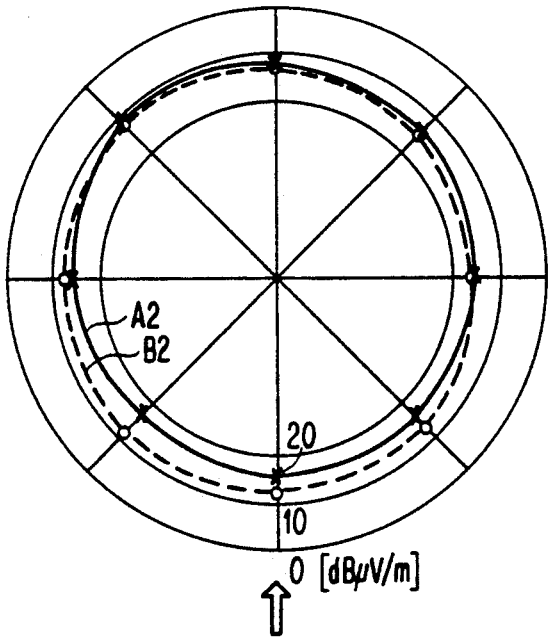

ANTENNA STRUCTURE USED IN PORTABLE RADIO DEVICE

This is a continuation of application Ser. No. 07/375,558 filed Jul. 5, 1989, now abandoned.

BACKGROUND OF THE INVENTION

The present invention relates to an antenna structure used in a portable radio device and, more particularly, to an antenna structure suitable for a portable radio device operating in a UHF (ultra high frequency) band.

A loop antenna has been employed in a portable radio device, such as a paging receiver, for its compactness. The loop antenna has strong directivity. Thus, if the radio device is held so that the loop antenna is in the direction of minimum sensitivity, the signal reception sensitivity will be deteriorated. This problem will be discussed herein referring to the accompanying drawings.

In order to avoid the problem mentioned above, it is known to use a loop antenna with a slender conductive element which is placed along a line perpendicular to a plane including the loop antenna and intersecting at a center of the loop antenna and which is inductively coupled to the loop antenna. This antenna structure is, however, not suitable for a portable radio device due to its bulkiness.

SUMMARY OF THE INVENTION

An object of the present invention is, therefore, to provide a generally improved antenna structure which eliminates the above-mentioned problems.

Another object of the present invention is to provide an antenna structure suitable for a portable radio device.

Yet another object of the present invention is to provide an antenna structure having good directivity.

Still yet another object of the present invention is to provide an antenna structure having a loop antenna and a supplemental antenna whose structure is compact while having a high antenna gain even if the loop antenna is positioned to have a minimum gain.

According to the present invention, there is provided an antenna structure comprising a loop antenna electrically connected to a high-frequency circuit of a portable radio device. The antenna structure also comprises a supplemental antenna including a coil spring which is used for fixing a dry battery powering the portable radio device, and a negative cylindrical conductor of the dry battery whose conductor is electrically connected with the coil spring. The coil spring is placed to be inductively coupled to the loop antenna. The axis line of the dry battery is substantially perpendicular to a plane including the loop antenna. Thus, deterioration in signal reception sensitivity due to the directivity of the loop antenna can be compensated by the supplemental antenna.

BRIEF DESCRIPTION OF THE DRAWINGS

The above and other objects, features and advantages of the present invention will become more apparent from the following description referring to the accompanying drawings, in which:

FIG. 1 is a perspective view showing a prior art antenna structure employed in a portable radio device;

FIGS. 2A and 2B are perspective views for explaining the directivity of the FIG. 1 antenna structure;

FIG. 3 is a graph illustrating the horizontal antenna characteristics of the FIG. 1 antenna structure;

FIG. 7 is a perspective view showing an antenna structure according to an embodiment of the present invention;

FIGS. 8A and 8B are perspective views for explaining the directivity of the FIG. 7 antenna structure; and FIG. 9 is a graph illustrating the horizontal antenna characteristics of the FIG. 7 antenna structure.

DETAILED DESCRIPTION OF THE PREFERRED EMBODIMENTS

Figure 4:
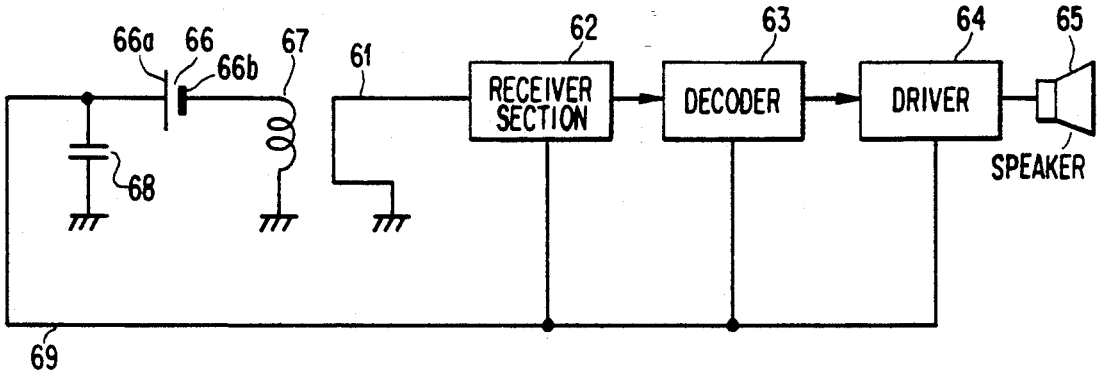
FIG. 4 is a block diagram of a radio paging receiver embodying the present invention.

To better understand the present invention, the prior art antenna structure used in a radio paging receiver will first be described. In FIG. 1, the radio paging receiver includes a housing 1 accommodating communication circuitry 2, a loop antenna 3, a connecting pattern 3*a*, a dry battery 4 and a printed circuit board 5. The loop antenna 3 is mounted on the printed circuit board 5 and electrically connected through the connecting pattern 3*a* to the communication circuitry 2.

Since the loop antenna 3 has strong directivity, it is mounted on the board 5 so that the antenna 3 has a maximum gain with respect to a vertical polarized wave A in a standard use condition shown in FIG. 2A. When the receiver is held by the user as shown in FIG. 2B, however, the antenna gain is extremely deteriorated and thus the signal reception sensitivity is decreased, as mentioned earlier.

FIG. 3 shows the horizontal antenna characteristics of loop antenna shown in FIGS. 1, 2A and 2B. The antenna characteristics were obtained for a prior art antenna 1 mounted on a paging receiver and receiving a signal of 900 MHz. The solid line A1 indicates horizontal reception sensitivity in free space for the condition of FIG. 2A. Dotted line B1 indicates horizontal reception sensitivity in free space for the condition of FIG. 2B. As can be seen from the FIG. 3 graph, the sensitivity indicated by the dotted line B1 is deteriorated in all directions, compared with the sensitivity indicated by the solid line A1. Thus, the prior art antenna structure shown in FIGS. 1, 2A and 2B is not suitable for a portable radio device, such as a paging receiver.

FIG. 4 shows a block diagram of a paging receiver embodying the present invention. In FIG. 4, a loop antenna 61 picks up a radio signal and supplies it to a receiver section 62. The receiver section 62 amplifies, frequency converts and demodulates the radio signal to produce a demodulated baseband signal. The baseband signal is supplied to a decoder 63 at which the baseband signal is wave shaped and compared with a paging number assigned to the paging receiver and stored therein. If the baseband signal contains a paging number identical with the stored paging number, the decoder 63 will produce an alert signal. Upon the alert signal, a driver 64 drives a speaker 65 to generate an alert sound, so that the user is informed of being paged. The driver 64 and the speaker 65 may constitute an annunciator means.

A battery 66 applies power through a line 69 to the receiver section 62, decoder 63 and driver 64. The positive terminal 66a of battery 66 is connected through a capacitor 68 to common potential. The negative terminal 66b of the battery is connected to the common potential through a coil spring 67. The negative terminal 66b and the coil spring 67 constitute a supplemental antenna which is inductively coupled to the loop antenna 61. A radio signal picked up by the supplemental antenna (66b, 67) is supplied to the loop antenna 61 and then to the receiver section 62. The supplemental antenna is arranged to compensate deterioration in the antenna gain due to the directivity of the loop antenna 61.

Figure 5:
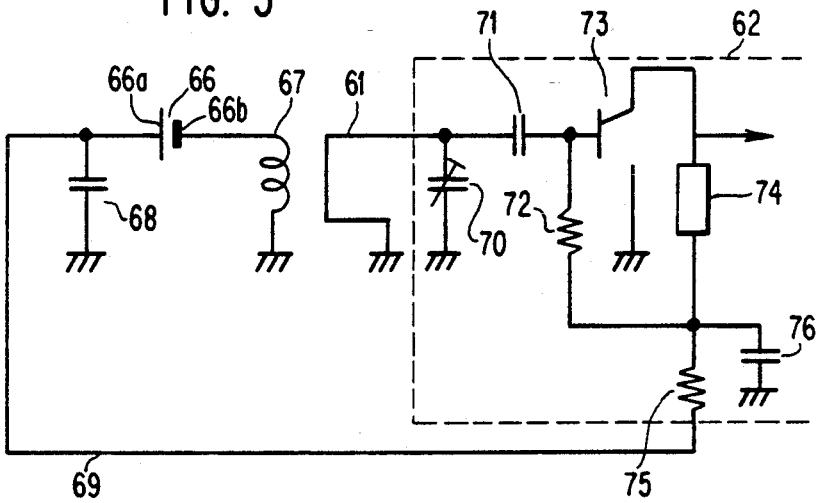
FIG. 5 is a schematic circuit diagram showing an antenna structure and a high-frequency circuit of the receiver shown in FIG. 4.

In FIG. 5, a radio signal picked up by the loop antenna 61 and by the supplemental antenna (66b, 67) is applied to a base of a high-frequency transistor amplifier 73 through a resonance matching circuit composed of a variable capacitor 70 and a capacitor 71. The variable capacitor 70 is connected between the loop antenna 61 and the common potential. The capacitor 71 is connected between the loop antenna 61 and the base of transistor 73. The common-emitter transistor 73 amplifies the radio signal and supplies the amplified signal to a frequency converter within the radio section 62. A resistor 75 is inserted between the base of transistor 73 and the battery 66. A capacitor 76 is inserted between the base of the transistor 73 and the common potential. A resistor 72 is a bias resistor of transistor 73. A pattern inductance element 74 is of a collector load of transistor 73.

Figure 6:
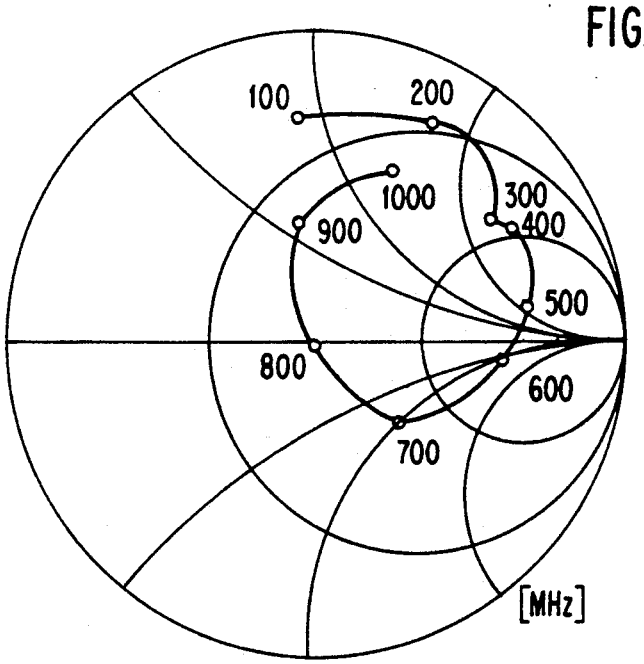
FIG. 6 is a Smith chart plot of an impedance characteristic of a supplemental antenna within the antenna structure shown in FIGS. 4 and 5.

When disconnecting the coil spring 67 from the common potential and measuring the impedance between the open terminal of spring coil 67 and the common potential, the measured impedance is plotted on the Smith chart of FIG. 6. The measured impedance does not change even if the positive terminal 66a is opened, i.e., the capacitor 68 and the line 69 are eliminated from the battery 66. In other words, the measured impedance is dominated by the negative terminal 66b and coil spring 67 and not affected by the positive side circuitry of battery 66.

By inductively coupling the supplemental antenna (66b, 67) to the loop antenna 61, a high-frequency power induced on the supplemental antenna is passed to the loop antenna 61 and then to the transistor amplifier 73. Furthermore, by making the supplemental antenna intersect perpendicularly to a plane including the loop antenna 61, the supplemental antenna compensates for deterioration in the signal reception sensitivity caused by the directivity of the loop antenna 61.

In FIG. 7, a housing 11 and communication circuitry 12 are indicated by an imaginary line and a dotted line, respectively. The circuitry 12 may include the receiver section 62, the decoder 63, the driver 64 and the speaker 65 shown in FIG. 4. A loop antenna 13 is composed of a substantially loop shaped conductor. The loop antenna 13 is connected with a common potential pattern 12a through a conductive pattern 13a of printed circuit board 15 and corresponds to the loop antenna 61 of FIGS. 4 and 5.

One end of a coil spring, or helical conductor, 16 is in contact with the negative terminal 14b of a dry battery 14 whose cylindrical conductor 14c has the same potential as the negative terminal 14b. The other end of coil spring 16 is connected with the negative terminal projection 17 which in turn is connected with the common potential pattern 12a through a conductive pattern 14a. The coil spring 16 and the battery negative terminal 14b and 14c constitute a supplemental antenna corresponding to the supplemental antenna (66b, 67) of FIGS. 4 and 5.

The combined lengths of the battery 14 and the coil spring 16 is set equal to one quarter of a wavelength used. Thus, the supplemental antenna constitutes a base-loaded antenna whose electrical length is increased by the addition of loading coil (16) in series with the antenna (14b) at the common potential. The combined lengths may instead be set to an odd multiple of one quarter of the used wavelength. It is, however, not desirable to set the combined lengths to a value other than one quarter of the wavelength, because the longer the combined lengths becomes, the more bulky the antenna structure.

The supplemental antenna having the coil spring 16 and the cylindrical battery conductor 14c is substantially perpendicular to a plane including the loop antenna 13 and substantially along a line intersecting perpendicularly the center of the loop of loop antenna 13. In other words, the axis line of the battery substantially perpendicularly intersects the center of the loop of loop antenna 13. Thus, if the radio device is placed as shown in FIG. 8A so that the plane including the loop antenna 13 is parallel to the vertical polarized wave A, the loop antenna 13 operates like the prior art antenna (FIG. 1) and induces maximum power while the supplemental antenna induces minimum power. On the other hand, if the radio device is placed as shown in FIG. 8B so that the axis line of the battery 14 is parallel to the vertical polarized wave A, the supplemental antenna operates as a main antenna and induces maximum power while the loop antenna 13 induces minimum power. Since the supplemental antenna, especially the loading coil 16, is inductively coupled to the loop antenna 13, no deterioration in the signal reception sensitivity occurs even if the loop antenna 13 is placed to induce minimum power.

In FIG. 9, the horizontal antenna characteristics of the antenna embodying the present invention in free space are shown. The plot of FIG. 9 is obtained using an antenna according to this invention mounted on a paging receiver and receiving a signal at a frequency of 900 MHz. Solid line A2 indicates a horizontal signal reception sensitivity measured for the paging receiver placed as shown in FIG. 8A. Dotted line B2 indicates a horizontal signal reception sensitivity gain measured for the paging receiver placed as shown in FIG. 8B. Because of the supplemental antenna, no deterioration in either cases occurs.

By comparing the antenna gains along a common direction, the present antenna (FIG. 7) has been determined to have a gain of −10 dB relative to a half-wave dipole while the prior art antenna (FIG. 1) has a gain of −30 dB relative to a half-wave dipole. Thus, the antenna gain about 20 dB can be improved by according to the present invention.

In practice, the wavelength at 900 MHz is about 33.3 centimeters one quarter of which is around 8.3 centimeters. The length of the negative cylindrical conductor of the dry battery is about 4.2 centimeters. Thus, the effective length of the coil spring 16 is around 4.0 centimeters. One end of the coil spring is in contact with the negative terminal 14b of the battery. This contact portion of the coil spring does not contribute to its effective length. The portion other than the contact portion should be made as thick as possible to reduce the inductance.

In summary, according to the present invention, the antenna structure has a supplemental antenna inductively coupling to the loop antenna and including a coil spring and the battery negative cylindrical conductor which is perpendicular to a plane including the loop antenna. Thus, even if the gain of the loop antenna is reduced due to its directivity, such gain reduction can be compensated by the supplemental antenna.

What is claimed is:

1. An antenna structure used in a portable radio device, comprising:

battery means for supplying power to said radio device, said battery means having a negative terminal and a cylindrical conductor electrically connected to said negative terminal;

loop antenna means, one end of which is connected to a common potential and the other end of which is connected to said portable radio device, the longitudinal axis of said battery means being substantially perpendicular to a plane including said loop antenna; and coil spring means one end of which is connected to said common potential and the other end of which is electrically connected to said negative terminal, said coil spring means being inductively coupled to said loop antenna means.

2. An antenna structure as claimed in claim 1, wherein the sum of the lengths of said coil spring means and said cylindrical conductor is substantially one quarter of a wavelength used by said radio device.

3. An antenna structure as claimed in claim 1, wherein said radio device is a 900 MHZ drive, and wherein the length of said coiled spring means is substantially equal to 4.0 centimeters, and wherein the length of said cylindrical conductor is substantially equal to 4.2 centimeters.

4. An antenna structure as claimed in claim 1, wherein said radio device comprises:

receiver section means for receiving a radio signal from said antenna structure and for demodulating said radio signal to produce a demodulated signal;

decoder means for comparing a paging number contained in said demodulated signal with a paging number assigned to said radio device and for producing an alert signal if they are identical; and annunciator means responsive to said alert signal for generating an alert sound.

5. An antenna structure as claimed in claim 4, wherein said annunciator means comprises speaker means and driver means responsive to said alert signal for driving said speaker to generate said alert sound.

6. An antenna structure as claimed in claim 4, wherein said receiver section comprises:

resonant matching circuit means whose input is connected with said other end of said loop antenna means, and amplifier means for amplifying the output of said resonant matching circuit means and for supplying the amplified signal to said decoder means.

7. An antenna structure as claimed in claim 6, wherein said resonant matching circuit means comprises a variable capacitor connected between said other end of said loop antenna means and said common potential; and a capacitor connected between said other end of said loop antenna means and the input of said amplifier means.

8. An antenna structure as claimed in claim 6, wherein said amplifier means comprises a transistor whose base, emitter and collector are connected with the output of said resonant matching circuit means, with said common potential and with the output of said amplifier means, respectively; a resistor connected between said base and said battery means; and an inductance element connected between said collector and said battery means.

9. An antenna used in a portable radio device, comprising:

loop antenna means for picking up a radio signal;

matching circuit means for impedance matching said loop antenna means and a radio section of said radio device; and supplemental antenna means inductively coupled in parallel to said loop antenna means with respect to a common potential for picking up a radio signal, said supplemental antenna means having first conductor means inductively coupled to said loop antenna means and second conductor means electrically connected with said first conductor means and substantially perpendicular to a plane including said loop antenna means.

10. An antenna as claimed in claim 9, wherein said first conductor means comprises a helically shaped conductor and said second conductor means comprises a cylindrical conductor.

11. An antenna as claimed in claimed 10, wherein said cylindrical conductor comprises a negative cylindrical conductor of a battery, said battery supplying power to said radio device and wherein said helically shaped conductor comprises a negative coil spring terminal electrically connecting a negative terminal of said battery with said radio device and fixing said battery.

12. An antenna as claimed in claim 11, wherein said radio device comprises a radio paging receiver.

13. An antenna as claimed in claim 12, wherein said radio paging receiver is used at 900 MHz, and wherein the length of said negative spring terminal is substantially equal to 4.0 centimeters, and wherein the length of said negative cylindrical conductor is substantially equal to 4.2 centimeters.

14. An antenna as claimed in claim 11, wherein the sum of the lengths of said coil spring and said cylindrical conductor is substantially equal to one quarter of a frequency used in said radio device.

15. An antenna comprising:

a first conductor formed as a loop and connected through a resonant matching circuit to a communication circuit; and a second conductor arranged along a linear line substantially perpendicular to a plane including said loop, intersecting said plane at a substantial center of said loop and having an electric length in its longitudinal direction approximated to an odd multiple of one-fourth of an operating wavelength, said second conductor including a negative electrode cylinder of a battery and a helical conductor, said helical conductor being in contact with an outer surface of a portion of said cylinder to connect a negative potential of said battery to common potential of said communication circuit.

16. An antenna as claimed in claim 15, wherein said communication circuit operates at 900 MHz, and wherein said cylinder substantially has the length of 4.2 centimeters, and wherein said helical conductor substantially has the length of 4.0 centimeters.

17. An antenna as claimed in claim 15, wherein said communication circuit comprises a radio paging receiver.

18. A paging receiver comprising:

antenna means for picking up a radio signal;

receiver section means connected to said antenna means for demodulating said radio signal to produce a baseband signal;

decoder means for detecting from said baseband signal a paging number assigned to said paging receiver;

annunciator means responsive to the detection of said paging number for generating an alert signal; and battery means for supplying power to said receiver section means, decoder means and annunciator means, wherein said battery means comprises a dry battery having a cylindrical conductor and a negative terminal electrically connected with said cylindrical conductor, and wherein said antenna means comprises:

a loop antenna connected between said receiver section and common potential of said receiver, the longitudinal axis of said cylindrical conductor being substantially perpendicular to a plane including said loop antenna; and a coil spring connected between said negative terminal and said common potential for fixing said dry battery, said coiled spring being inductively coupled to said loop antenna.

19. A paging receiver as claimed in claim 18, wherein the sum of the lengths of said cylindrical conductor and said coil spring is substantially equal to an odd multiple of one quarter of a frequency used in said paging receiver.

20. A paging receiver as claimed in claim 19, wherein the number of said odd multiple is one.

21. A paging receiver as claimed in claim 18, wherein the length of said cylindrical conductor is substantially equal to 4.2 centimeters, and wherein the length of said coil spring is substantially equal to 4.0 centimeters.

22. An antenna structure comprising:

loop antenna means electrically connected to a high-frequency circuit of a portable radio device; and supplemental antenna means having a coil spring which fixes a dry battery powering said portable radio device, and a cylindrical conductor of said dry battery which conductor is electrically connected with said coil spring, said coil spring being placed to be inductively coupled to said loop antenna means, the longitudinal axis of said cylindrical conductor being substantially perpendicular to a plane including said loop antenna means.

23. A method of picking up a radio signal for a portable radio device powered by a battery and including a loop antenna, said method comprising the following steps of:

connecting one end of said loop antenna with a common potential of said radio device;

connecting one end of a coil spring with said common potential;

connecting the other end of said coil spring with a negative terminal of said battery;

placing said battery so that the longitudinal axis of a negative cylindrical conductor of said battery is substantially perpendicular to a plane including said loop antenna and;

placing said coil spring so that said coil spring inductively couples to said loop antenna.

24. A method as claimed in claim 23, further comprising the steps of:

demodulating a radio signal from said loop antenna to produce a demodulated signal;

detecting from said demodulated signal a paging number assigned to said radio device to produce a detection signal; and responsive to said detection signal, generating an alert signal.

25. An antenna used in a portable radio device, comprising:

first antenna means for picking up a radio signal, said first antenna means inducing maximum power when said radio device is in a first position, said first antenna means including a loop antenna;

matching circuit means for impedance matching said first antenna means and a radio section of said radio device; and second antenna means for picking up a radio signal, said second antenna means inducing maximum power when said radio device is in a second position different from said first position and including supplemental antenna means inductively coupled in parallel to said loop antenna with respect to a common potential and substantially perpendicular to a plane including said loop antenna.

26. An antenna as claimed in claim 25, wherein said supplemental antenna means comprises a negative cylindrical conductor of a battery supplying power to said radio device, the axis of said negative cylindrical conductor being perpendicular to said plane; and a negative coil spring terminal electrically connecting a negative terminal of said battery with said radio device and fixing said battery.

* * * * *